US006724346B2

(12) United States Patent
Le Bolzer et al.

(10) Patent No.: US 6,724,346 B2
(45) Date of Patent: Apr. 20, 2004

(54) DEVICE FOR RECEIVING/TRANSMITTING ELECTROMAGNETIC WAVES WITH OMNIDIRECTIONAL RADIATION

(75) Inventors: Françoise Le Bolzer, Rennes (FR); Ali Louzir, Rennes (FR)

(73) Assignee: Thomson Licensing S.A., Boulogne (FR)

( * ) Notice: Subject to any disclaimer, the term of this patent is extended or adjusted under 35 U.S.C. 154(b) by 0 days.

(21) Appl. No.: 10/152,665

(22) Filed: May 21, 2002

(65) Prior Publication Data

US 2003/0020663 A1 Jan. 30, 2003

(30) Foreign Application Priority Data

May 23, 2001 (FR) ..... 0106770

(51) Int. Cl.[7] ..... H01Q 1/38

(52) U.S. Cl. ..... 343/700 MS; 343/729; 343/770; 343/795

(58) Field of Search ..... 343/700 MS, 795, 343/797, 770, 767, 729

(56) References Cited

U.S. PATENT DOCUMENTS 6,366,254 B1 * 4/2002 Sievenpiper et al. ..... 343/770

FOREIGN PATENT DOCUMENTS

| | | |
|---|---|---|
| CA | 2 210 080 | 1/1999 |
| EP | 0301 216 | 2/1989 |
| FR | 2 785 476 | 5/2000 |
| GB | 2 272 575 | 5/1994 |

OTHER PUBLICATIONS

Vaugham M.J. et al.: "28 GHZ Omni–Directional Quasi–Optical Transmitter Array", IEEE Transactions on microwave Theory and Techniques, vol. 43, No. 10, Oct. 1, 1995, pp. 2507–2509, XP000530205.

French Search Report of Jan. 17, 2002.

* cited by examiner

*Primary Examiner*—Michael C. Wimer

(74) *Attorney, Agent, or Firm*—Joseph S. Tripoli; Kuniyuki Akiyama

(57) ABSTRACT

The present invention relates to a device for receiving/transmitting electromagnetic waves with omnidirectional radiation of the type comprising: a first set (100*a*, 100*b*, 100*c*, 100*d*) of means for receiving/transmitting waves with longitudinal radiation of the printed antenna type, the said means being arranged in order to receive a wide azimuthal sector and at least a second means (104) for receiving/transmitting waves with transverse radiation of the printed antenna type, the second means having radiation complementary to the radiation of the first means, and means (103) capable of connecting in emission the said first and second wave receiving/transmitting means. The invention is especially applicable to domestic networks.

11 Claims, 6 Drawing Sheets

DEVICE FOR RECEIVING/TRANSMITTING ELECTROMAGNETIC WAVES WITH OMNIDIRECTIONAL RADIATION

FIELD OF THE INVENTION

The present invention relates to a device for receiving/transmitting electromagnetic waves with omnidirectional radiation of the antenna-type which can be used most particularly in the field of wireless transmissions.

BACKGROUND OF THE INVENTION

In the case of domestic networks using wireless transmissions, the antenna design must comply with particular requirements which especially result from the topology of the environment. Thus in this type of application, as shown in FIG. 1, communicating devices which may be located at any point in the same room, in different rooms or even on different floors or levels must be considered. For example, FIG. 1 shows a house with four rooms, three 1, 1', 1" of which have communicating equipment. Room 1 has a decoder 2 connected to a television set 3, the decoder being connected to an antenna 4 communicating with a satellite 5. Moreover, the decoder 2/television set 3 assembly is fitted with an antenna 6 belonging to a wireless network capable of communicating via an antenna 9 with a computer 7 and a CD ROM reader 8 placed in another room 1'. These assemblies must also be able to communicate with another television set 10 positioned in a room 1" on a lower floor. Under these conditions, and so as to ensure complete coverage of the communication space for the purpose of connecting all the terminals of the network, it would appear necessary to design antennas having omnidirectional radiation.

At present, the antennas most commonly used to meet the requirements for omnidirectional radiation consist of dipole antennas or antennas of the patch type.

A dipole antenna referenced 20 enables azimuthal omnidirectional coverage to be obtained, as shown in FIG. 2, however it has a hole in the axis defined by the radiating element. Consequently, although the dipole antenna is able to communicate with the telephone 21 and the television set 22 located on the same floor, connection with the computer 23 located on an upper floor is not guaranteed.

With regard to the printed antennas of the patch type, as shown in FIG. 3, they comprise schematically a substrate 30 on which a printed patch 31 is produced. As a result, the patch antenna has hemispherical radiation 32, which limits the coverage to the upper half-space of the earth plane 30.

To overcome the coverage problem, several antenna topologies have been proposed. However, they all lead to three-dimensional configurations in which the printed antennas are produced on supports of any shape. Now, these solutions are still bulky and their manufacture tricky for mass production.

The aim of the present invention is therefore to overcome the above drawbacks by proposing a new antenna topology guaranteeing, on the one hand, overall coverage of space and, on the other hand, limited bulk. This new topology is based on a type of printed antennas such as the Vivaldi antennas, proposed in French Patent Application No. 98-13855 filed in the name of the applicant. The antenna proposed in the aforementioned patent application consists of a coplanar circular arrangement, about a central point, of Vivaldi-type printed radiating elements, making it possible to present several directional beams sequentially over time, the set of beams giving complete 360° coverage of space. Improvements have been made to this type of antennas, in particular, in French Patent Application No. 00-15715 filed in the name of the applicant. In that application, an embodiment allowing an operating mode which is no longer sequential but simultaneous was proposed, that is to say that the set of beams operate at the same time, so as to generate omnidirectional radiation in contrast with the directional radiation of the embodiment described in the previous application. However, the pattern of the structure thus excited has areas of zero field in an angular sector surrounding the directions orthogonal to the plane of the substrate, this sector being called a blind zone. These blind zones are defined by the aperture in the H plane of the radiation pattern of an elementary "Vivaldi" antenna.

BRIEF SUMMARY OF THE INVENTION

The aim of the present invention is therefore to propose an improvement to the structure described above, which makes it possible to eliminate the areas of zero field described above.

Consequently, the subject of the present invention is a device for receiving/transmitting electromagnetic waves with omnidirectional radiation of the antenna type comprising a first set of means for receiving/transmitting waves with longitudinal radiation of the printed antenna type, the said means being arranged in order to receive a wide azimuthal sector, characterized in that it further comprises at least a second means for receiving/transmitting waves with transverse radiation of the printed antenna type, the second means having radiation complementary to the radiation of the first means, and means capable of connecting in emission the said first and second wave receiving/transmitting means.

According to a preferred embodiment, the means capable of connecting in emission the first set of means for receiving/transmitting waves with longitudinal radiation and the second means for receiving/transmitting waves with transverse radiation consist of a common feed line produced by printed technology. This common feed line is formed by a microstrip line or a coplanar line crossing all the slots of the printed slot antennas constituting the first receiving/transmitting set and the second receiving/transmitting means of the slot type, the length of the line between two slots of the first set being equal at the central operating frequency of the system to $k\lambda_m$, the length of the line between the last slot of the first set and the slot of the second receiving/transmitting means being equal at the central operating frequency of the system to $k\lambda_m/2$ and the length of the line between one end of the line and the slot of the second receiving/transmitting means being equal to $k'\lambda_m/4$ where $\lambda_m=\lambda_0/\sqrt{\epsilon_{reff}}$ where $\lambda_0$ is the wavelength in vacuo, $\epsilon_{reff}$ is the equivalent permittivity of the line, and k and k' are integers. When the second transmitting/receiving means of the slot type consists of a patch, the feed line is directly connected to the patch without additional length.

Furthermore, each means for receiving/transmitting waves with longitudinal radiation of the printed antenna type consists of a printed slot antenna of the Vivaldi antenna or Yagi antenna type, the antennas hereinabove being arranged at regular intervals around a single point and coplanar so as to be able to radiate over a 360° angle sector.

Similarly, the second means for receiving/transmitting waves with transverse radiation of the printed type consists of a slot which is symmetrical with respect to a point or an antenna of the patch type where only a connection to the upper or lower floor is necessary. This slot or this patch is circular or square. Thus, according to one characteristic of the invention, the first set of means for receiving/transmitting waves with longitudinal radiation and the second means for receiving/transmitting waves with transverse radiation are produced on the same substrate so as to be symmetric about the same point.

BRIEF DESCRIPTION OF THE DRAWINGS

Other characteristics and advantages of the present invention will become apparent on reading the description hereinafter of various preferred embodiments, this description being made with reference to the appended drawings in which.

DESCRIPTION OF PREFERRED EMBODIMENTS

In order to simplify the description in the figures, the same elements bear the same references.

Figure 1:
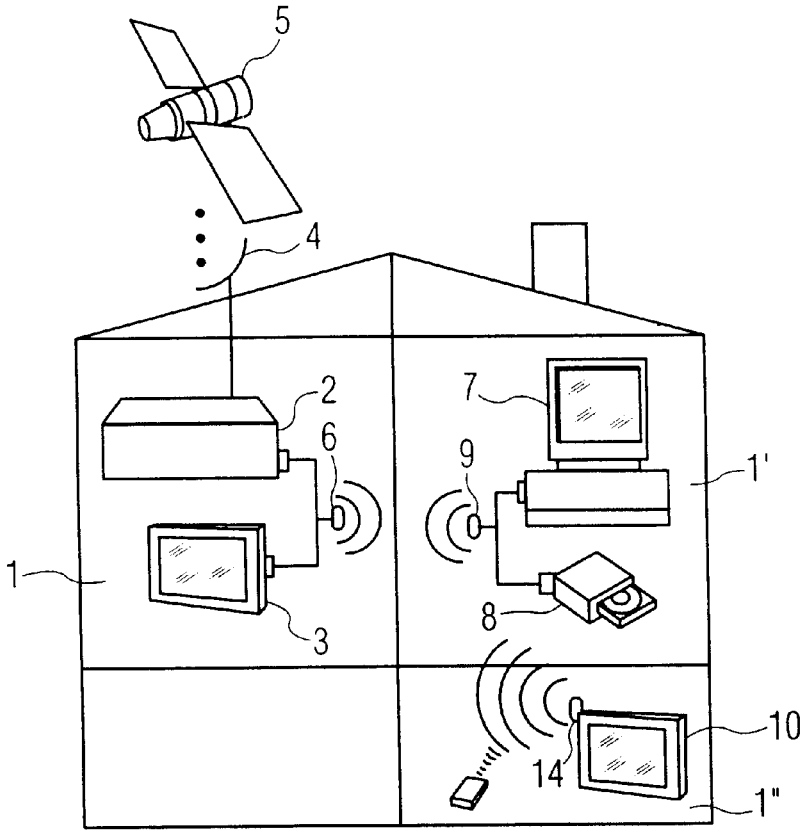
FIG. 1, already described, is a schematic sectional view of house furnished with equipment connected together using wireless technology, enabling explanation of the problem that the present invention has to solve, FIG. 2, already described, is a schematic view explaining the operation of one embodiment according to the prior art, FIG. 3, already described, is a schematic representation of another type of antenna used in the prior art.
Figure 2:
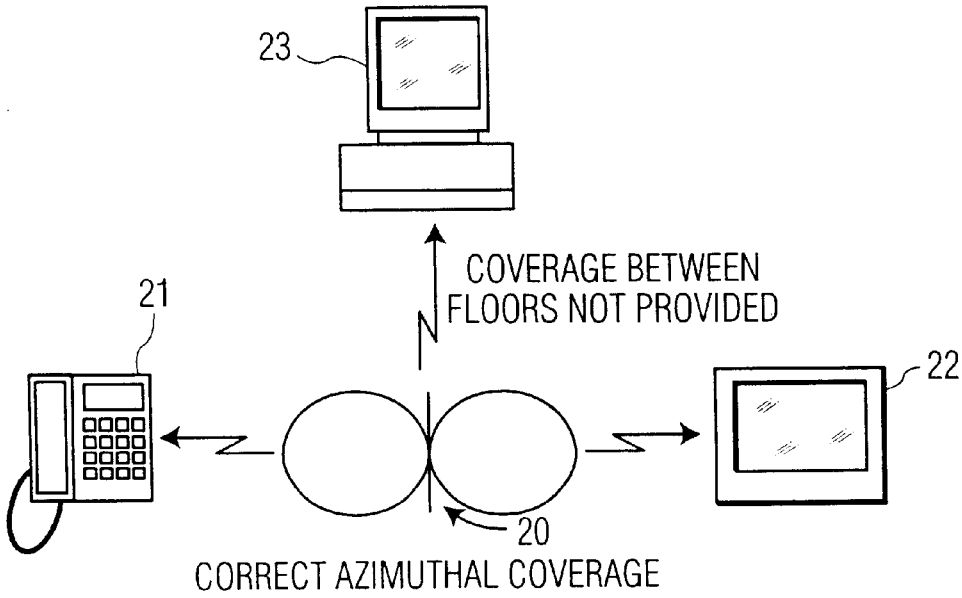
Figure 3:
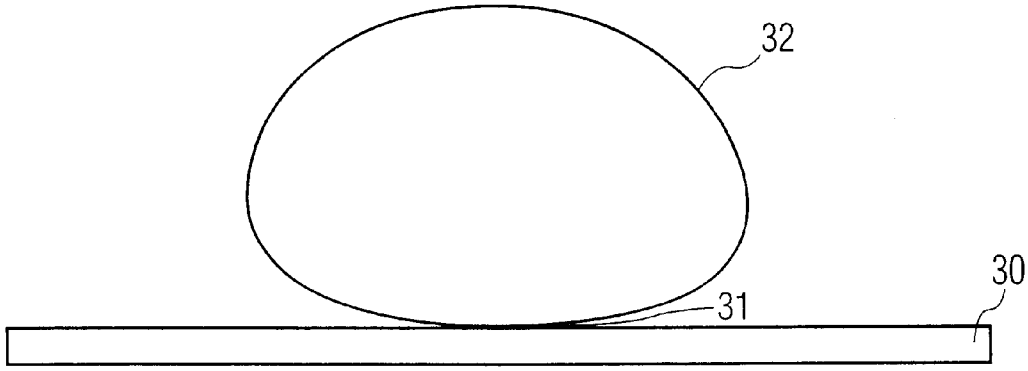
Figure 4:
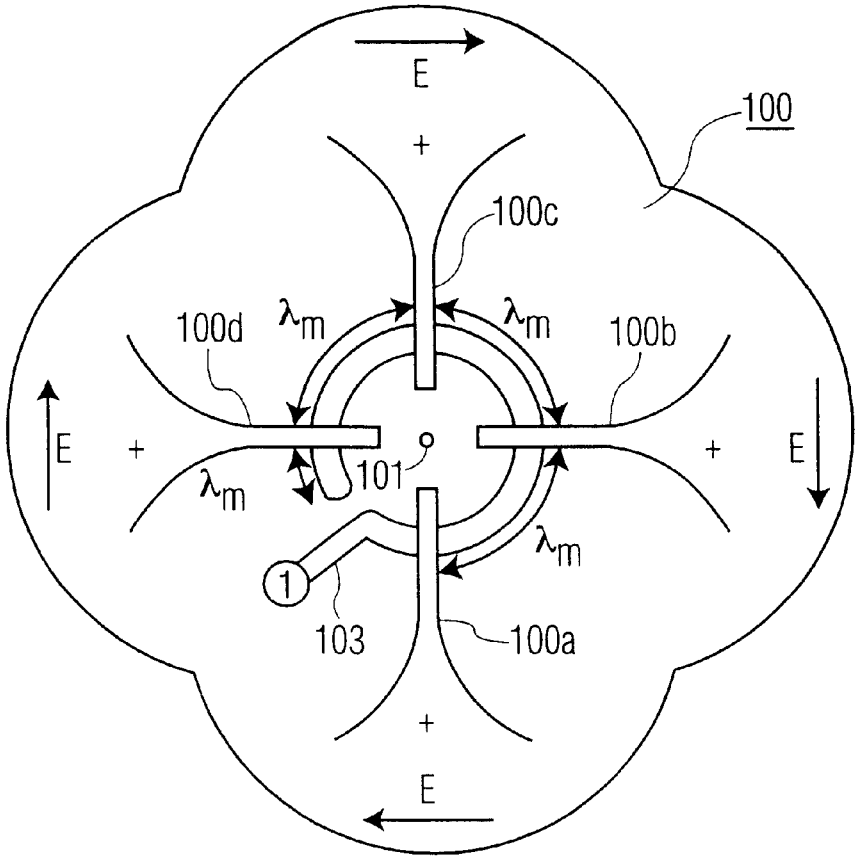
FIG. 4 is a schematic view of a device according to an embodiment of French Patent Application No. 00 15715 which can be used within the scope of the present invention.

FIG. 4 shows schematically a compact antenna of the type described in French Patent Application No. 98-13855 and comprising a feed line as described in French Patent Application No. 00-15715. In order to receive over an azimuthally wide sector, the means for receiving/transmitting longitudinal radiation in this case consist of four printed slot antennas 100*a*, 100*b*, 100*c*, 100*d*, made on the same substrate 100 and regularly spaced about a central point 101, the four antennas being positioned perpendicularly to each other on the common substrate. As shown schematically in FIG. 4, the slot antennas comprise a slot line which flares progressively from the centre 101 towards the outside of the structure so as to form an antenna of the Vivaldi type. The structure and the performance of the Vivaldi antenna are well known to a person skilled in the art and are described in particular in the documents "IEEE Transactions on Antennas and propagations" by S. Prasad and S. Mahapatra; Volume 2 AP 31 No. 3, May 1983 and in "Study of discontinuities in open waveguide-Application to improvement of a radiating source model" by A. Louzir, R. Clequin, S. Toutain and P. Gélin, LestUra C.N.R.S. No. 1329.

Figure 5:
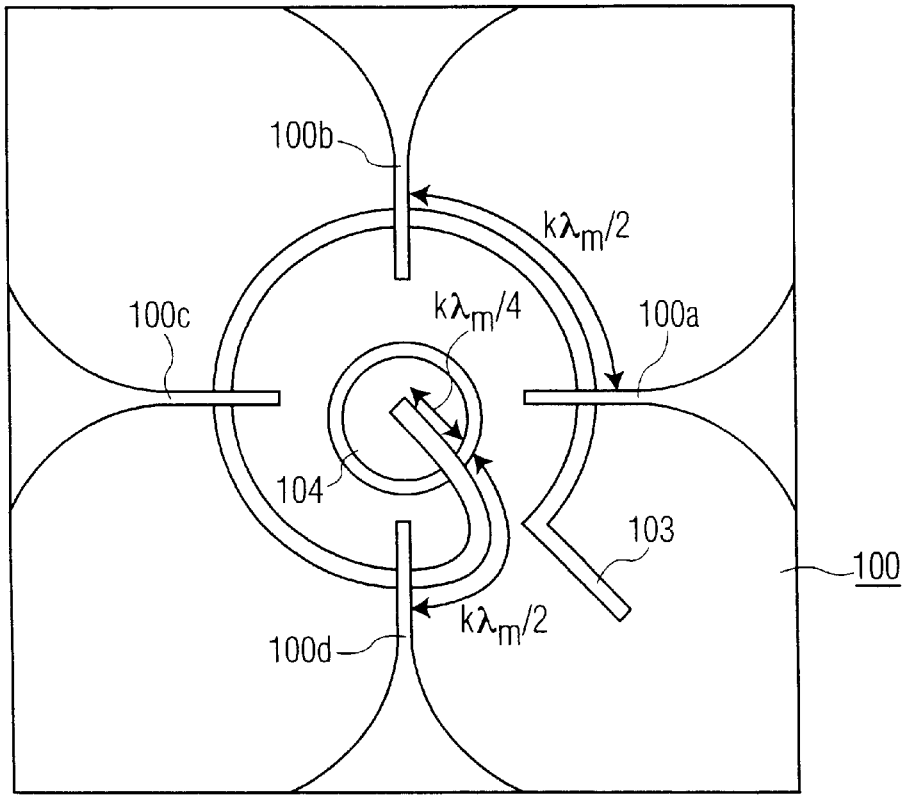
FIG. 5 is a top plan view of a first embodiment of the present invention.

As shown in FIG. 4, the four antennas 100*a*, 100*b*, 100*c*, 100*d* are connected to each other via a line 103 made from microstrip technology. This microstrip line makes it possible to produce line/slot transitions by electromagnetic coupling and is positioned so that the length of the line between two slots such as the slot of the antenna 100*a* and the slot of the antenna 100*b* is equal at the central operating frequency of the system, to $k\lambda_m$, $k\lambda_m$ providing in-phase operation in which $\lambda_m=\lambda_0/\sqrt{\epsilon_{reff}}$ where $\lambda_0$ is the wavelength in vacuo, k an integer and $\epsilon_{reff}$ the equivalent relative permitivity of the line. Moreover, in order to obtain correct operation in the omnidirectional mode, the end of the microstrip line 103 is at a distance $k'\lambda_m/4$ from the closest Vivaldi antenna 100*d*, where k' is an odd number and λm is given by the equation above. The other end of the feed line is connected in emission to means for transmitting signals of a known type, the said means especially comprising a power amplifier. When the slots of the Vivaldi antennas are fed by a feed line of the microstrip type having a length λm or kλm, as shown in FIG. 4, in-phase operation of the antennas is obtained, which gives an optimum radiation pattern, as shown in FIG. 4 by the arrows E giving the radiated electric field. However, the radiation pattern of the structure above has areas of zero field in an angular sector called a blind zone surrounding the directions orthogonal to the plane of the substrate. These blind zones are known since they are defined by the aperture in the H plane of the radiation pattern of an elementary Vivaldi antenna. Consequently, according to the present invention, in order to complete the two coverage regions which are lacking, as shown in FIG. 5, an antenna consisting of an annular slot 104 is combined with the antenna with omnidirectional radiation described above. As shown in FIG. 5, this antenna with an annular slot is fed by the microstrip line 103 and is at a distance kλm/2 from the slot of the Vivaldi antenna 100*d*, preferably kλm where λm is defined as above. In this case, the end of the microstrip line 103 is at a distance k'λm/4 from the annular slot 104. The use of an antenna with an annular slot, as shown in FIG. 5, enables the whole device for receiving/transmitting electromagnetic waves with omnidirectional radiation to be produced on the same substrate 100, using microstrip technology, which makes it possible to have an antenna which is compact and easy to produce.

Figure 6:
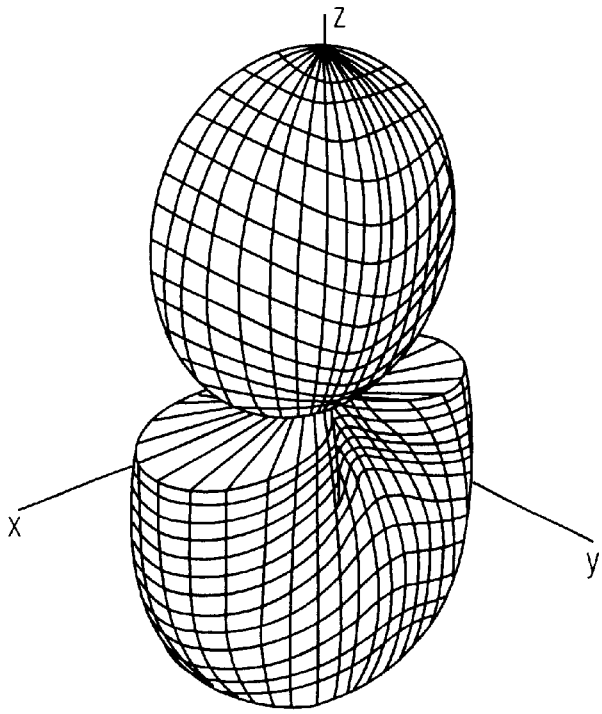
FIG. 6 shows the radiation pattern of an annular slot as used in the embodiment of FIG. 5.

As can be seen in FIG. 6, the radiation of an antenna with an annular slot consists of two lobes distributed on either side of the substrate in which the antenna is etched. In this way, with the structure of FIG. 5, the coverage zone is complemented with inter-floor connections.

In addition, in the embodiment described above, all the antennas are fed by the same feed line, made with microstrip technology. This excitation allows the energy transmitted by each radiating element to be controlled as a function of the impedance thereof. It is therefore possible to generate a perfectly isotropic pattern when all the elements have the same impedance or to favour the radiation in one or more particular sectors.

Figure 7:
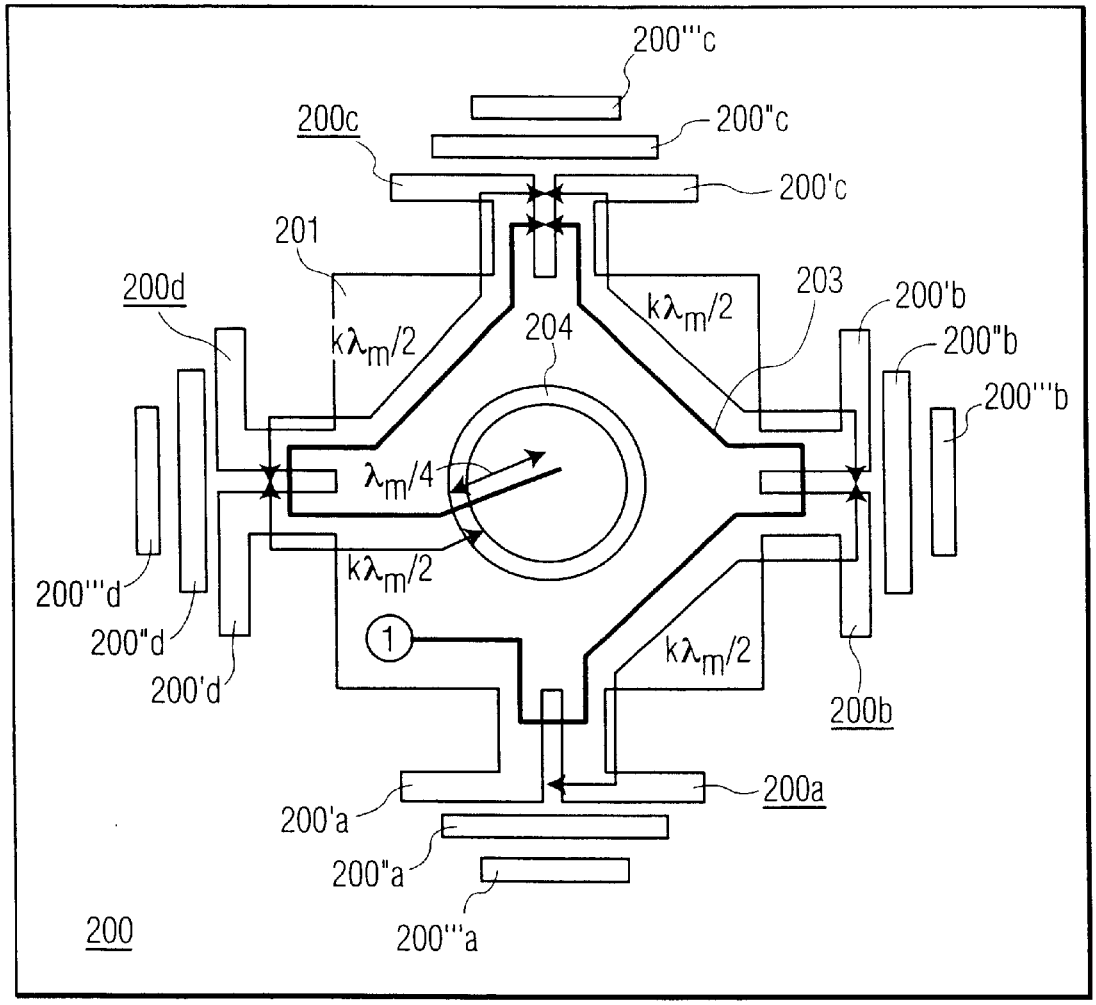
FIG. 7 is a top plan view of a second embodiment of the present invention.

Another embodiment of a device for receiving/transmitting electromagnetic waves with omnidirectional radiation, according to the present invention, will now be described with reference to FIG. 7. In this case, the antennas of the Vivaldi type have been replaced by printed antennas 200*a*, 200*b*, 200*c*, 200*d* of the Yagi type positioned perpendicularly to each other and symmetrically about a central common point 201. These Yagi-type antennas are made on a common substrate 200 using microstrip technology. Thus a Yagi-type dipole 200'*a*, 200'*b*, 200'*c*, 200'*d* combined with two directors 200"*a*, 200"*b*, 200"*c*, 200"*d* and 200"'*a*, 200"'*b*, 200"'*c*, 200"'*d* are produced in a metal earth plane. As shown in FIG. 7, the antennas are fed by a common feed line 203 also made from microstrip technology, the length of line between each antenna meeting the same criteria as in the case of Vivaldi-type antennas.

As shown in FIG. 7, the second means for receiving/transmitting waves with transverse radiation of the printed antenna type in this case therefore consists of an annular slot 204 fed by the common line 203. The operation of the Yagi antennas is identical to the operation of the Vivaldi-type antennas and they provide radiation over a 360° angle sector, the antenna 204 with an annular slot enabling coverage perpendicular to the coverage of the Yagi antennas. Operation of the Yagi-type antennas is known to a person skilled in the art and is in particular described in the article "Coplanar waveguide fed quasi-Yagi antenna", J. Sor, Yongxi Quian and T. Itoh, Electronics Letters, Jan. 6, 2000, Vol. 36, No. 1.

Figure 8:
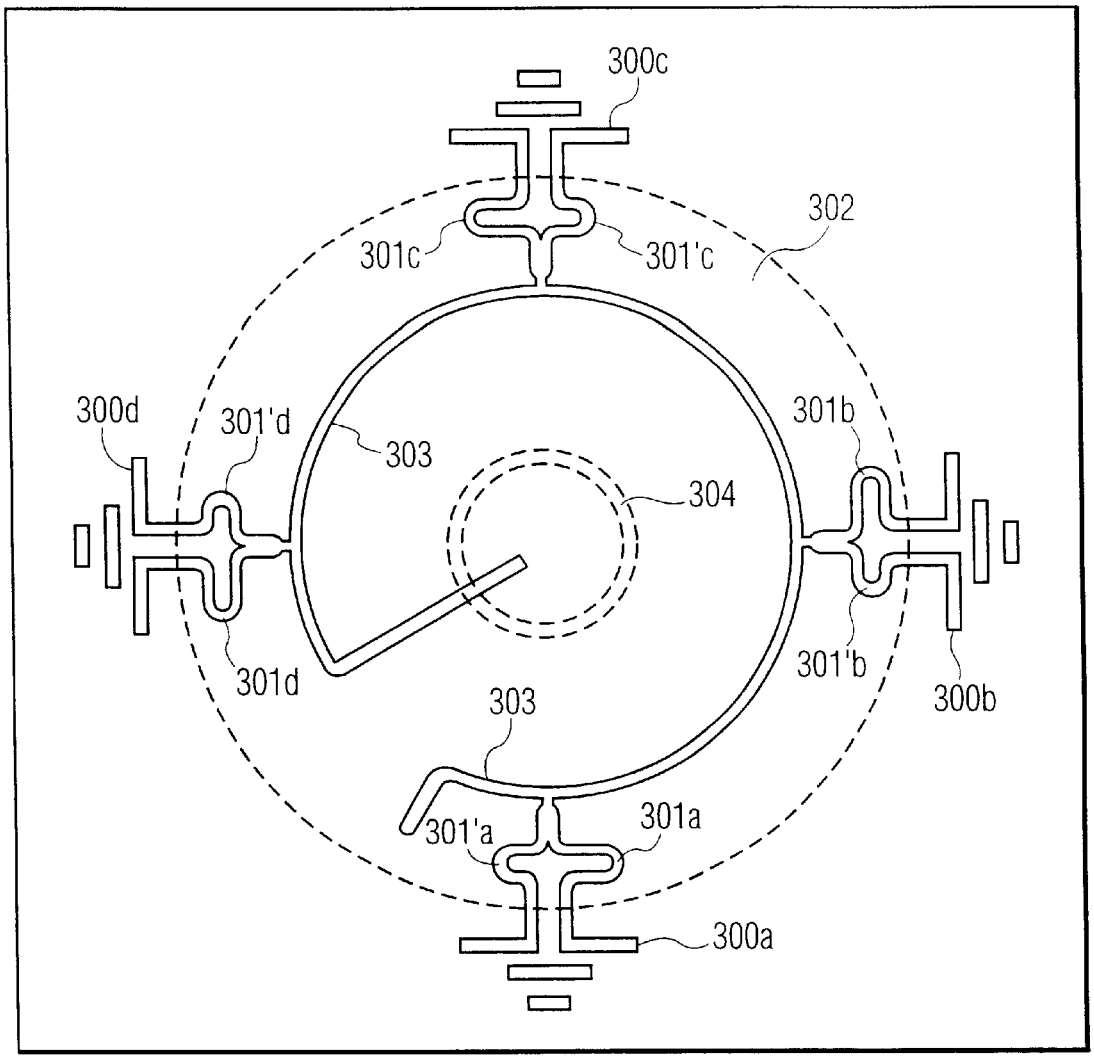
FIG. 8 is a top plan view of a third embodiment of the present invention.

Another embodiment of the invention using Yagi-type antennas 300*a*, 300*b*, 300*c*, 300*d* with a dipole and two directors, as in the embodiment of FIG. 7, will be described with reference to FIG. 8. In this case, the antennas are excited by an excitation line 303 made in microstrip technology. While in the embodiment of FIG. 7, the Yagi-type antennas operate by slot excitation, that is by electromagnetic coupling between the line 203 and the slots of the antennas, in the present case, the Yagi-type antennas are excited directly by the microstrip line 303. As a result, the dipoles of the antennas are extended by two microstrip lines 301*a*–301'*a*, 301*b*–301'*b*, 301*c*–301'*c*, 301*d*–301'*d* of different length. The operation of an antenna of this type is known to a person skilled in the art and described in the article "Investigation into the operation of a microstrip fed uniplanar quasi-Yagi antenna" H. J. Song, M. E. Bialkowski, The University of Queensland, Australia -APS 2000.

According to the invention, the second transmitting/receiving means consists of an annular slot 304 and the connection via the microstrip line 303 is made as in the embodiment of FIG. 7.

Figure 9:
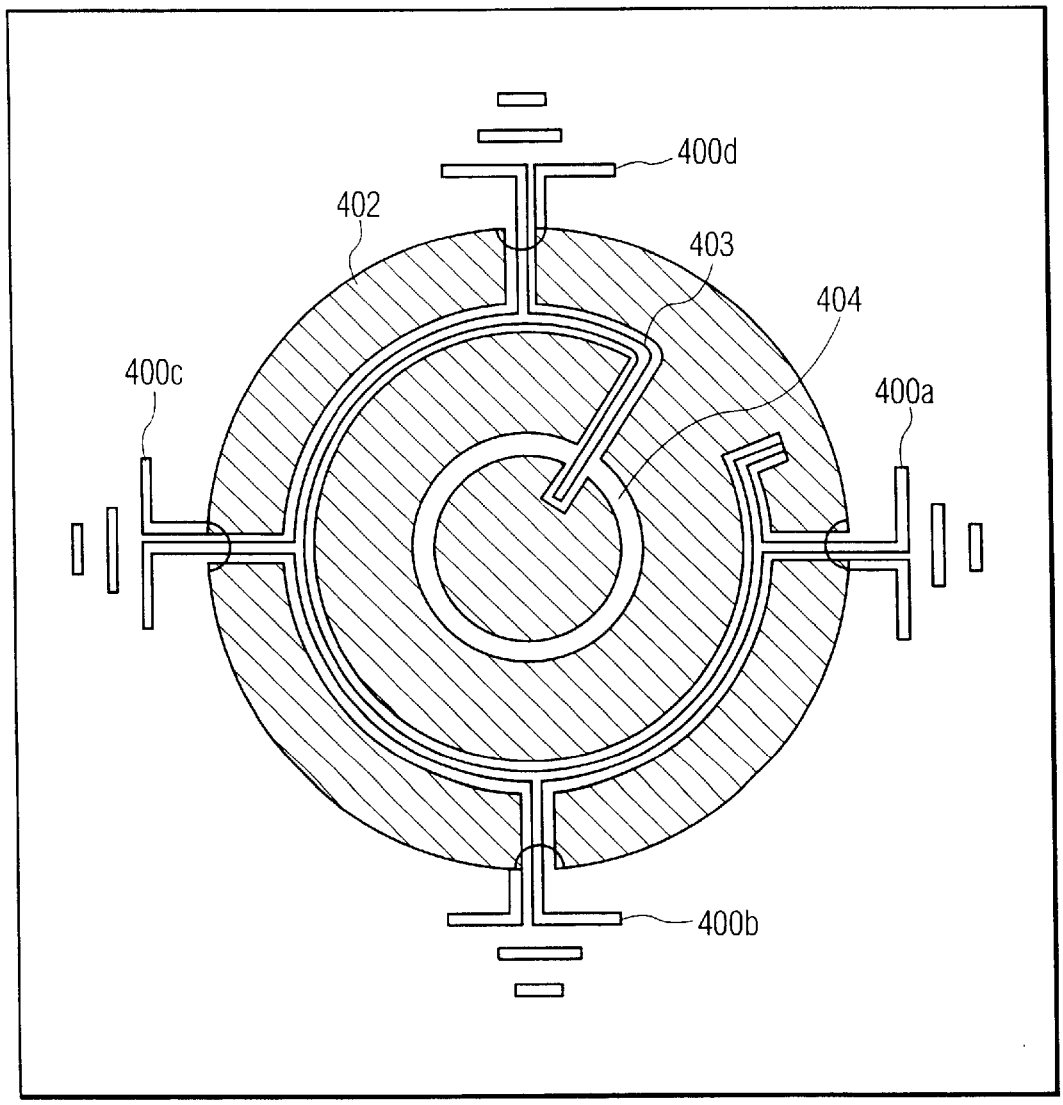
FIG. 9 is a bottom plan view of a fourth embodiment of the present invention.

In the embodiment of FIG. 9, Yagi-type printed antennas 400*a*, 400*b*, 400*c*, 400*d*, of the same type as used above, are used. However, in this case, the feed line 403 is a line of coplanar type made in a known manner in the earth plane 402. The operation of a structure of this type is described in the article "First demonstration of a conductor backed coplanar waveguide fed quasi-Yagi antenna" by K. M. K. Leong et al. of the University of California, Los Angeles which appeared in IEEE 2000.

In this case also, the second means for transmitting/receiving waves with transverse radiation consists of a slot 404.

Although unilateral transverse radiation is sufficient, the second means may be produced with an antenna of the patch type.

It is obvious to a person skilled in the art that the examples above are simply illustrative and can be modified without departing from the scope of the claims.

What is claimed is:

1. Antenna device for receiving/transmitting electromagnetic waves with omnidirectional radiation comprising:

a first set of printed antennas with longitudinal radiation, said first set of printed antennas being arranged in order to receive radiation on a wide azimuthal sector, at least a second printed antenna with transverse radiation, the second antenna having radiation complementary to the radiation of the first set of printed antennas, and a common feed line for connecting in emission said first set of printed antennas and said second printed antenna.

2. Device according to claim 1, wherein each printed antenna with longitudinal radiation consists of a printed Vivaldi antenna.

3. Device according to claim 2, wherein the antennas are arranged at regular intervals around a single point and are coplanar so as to be able to radiate over a 360° angle sector.

4. Device according to claim 1, wherein each printed antenna with longitudinal radiation of the printed antenna type consists of a Yagi antenna type.

5. Device according to claim 4, wherein the antennas are arranged at regular intervals around a single point and are coplanar so as to be able to radiate over a 360° angle sector.

6. Device according to claim 1, wherein the second printed antenna consists of a slot which is symmetrical with respect to a point.

7. Device according to claim 1, wherein the second printed antenna consists of an antenna of the patch type.

8. Device according to claim 1, wherein the first set of printed antennas with longitudinal radiation and the second printed antenna with transverse radiation are produced on the same substrate so as to be symmetric about the same point.

9. Device according claim 1, wherein the common feed line for connecting in emission the first set of printed antennas with longitudinal radiation and the second printed antenna with transverse radiation consists of a common feed line produced in printed technology.

10. Device according to claim 9, wherein the common feed line consists of a line crossing all the slots of the printed antennas constituting the first set of printed antennas as well as the second printed antenna of the slot type, the length of the line between two slots of the first set being equal at the central operating frequency of the system to $k\lambda_m$, the length of the line between the last slot of the first set and the slot of the second printed antenna being equal at the central operating frequency of the system to $k\lambda_m/2$ and the length of the line between the end of the line and the slot of the second printed antenna being equal to $k'\lambda_m/4$ where $\lambda_m=\lambda_0/\sqrt{\epsilon_{reff}}$ where $\lambda_0$ is the wavelength in vacuo and $\epsilon_{reff}$ the equivalent permittivity of the line, k is an integer and k' is another odd integer.

11. Device according to claim 9, wherein the common feed line consists of a line crossing all of the slots of the printed antennas constituting the first set, the length of the line between two slots of the first set is $k\lambda_m$ and the length of the line between the last slot of the first set and the second printed antenna of the patch type being equal at the central operating frequency of the system to $k\lambda_m/2$ where $\lambda_m=\lambda_0/\sqrt{\epsilon_{reff}}$ where $\lambda_0$ is the wavelength in vacuo, k is an integer and $\epsilon_{reff}$ the equivalent permittivity of the line.

* * * * *